US007070192B1

(12) United States Patent
Steiner

(10) Patent No.: US 7,070,192 B1
(45) Date of Patent: Jul. 4, 2006

(54) METHOD AND APPARATUS FOR STABILIZING A SKATEBOARD FOR TRAINING NOVICE USERS OF SKATEBOARD

(76) Inventor: Jonathan L. Steiner, 5152 Vincent Ave., Los Angeles, CA (US) 90041

( * ) Notice: Subject to any disclaimer, the term of this patent is extended or adjusted under 35 U.S.C. 154(b) by 69 days.

(21) Appl. No.: 10/386,830

(22) Filed: Mar. 12, 2003

(51) Int. Cl.
*B62M 1/00* (2006.01)

(52) U.S. Cl. ..... 280/87.042; 434/247

(58) Field of Classification Search ..... 280/7.12, 280/87.01, 87.021, 87.041, 87.042, 809, 280/811, 816, 825; 434/29, 247, 253, 255
See application file for complete search history.

(56) References Cited

U.S. PATENT DOCUMENTS

| | | | | | |
|---|---|---|---|---|---|
| 1,890,755 | A | | 12/1932 | Shepherd | |
| 3,153,543 | A | * | 10/1964 | Magyar | 280/7.13 |
| 3,671,055 | A | | 6/1972 | Aarup | |
| 3,887,210 | A | | 6/1975 | Funke | |
| D242,735 | S | | 12/1976 | Candler | |
| 4,092,787 | A | * | 6/1978 | Kaempfen | 434/253 |
| 4,099,734 | A | * | 7/1978 | Lowery | 280/11.216 |
| 4,235,448 | A | | 11/1980 | Thomas | |
| 4,288,088 | A | * | 9/1981 | Harrison | 280/87.042 |
| 4,744,576 | A | | 5/1988 | Scollan, Jr. | |
| 4,991,861 | A | * | 2/1991 | Carn et al. | 280/87.042 |
| 5,179,847 | A | * | 1/1993 | Dorn | 70/18 |
| 5,372,384 | A | | 12/1994 | Smith | |
| 5,381,870 | A | * | 1/1995 | Kaufman | 180/181 |
| 5,413,544 | A | | 5/1995 | Fiore | |
| 5,975,546 | A | | 11/1999 | Strand | |
| 6,035,976 | A | * | 3/2000 | Duhamel | 188/5 |
| RE36,967 | E | | 11/2000 | Hu | |
| 6,520,518 | B1 | * | 2/2003 | Lo | 280/87.041 |
| 6,616,583 | B1 | * | 9/2003 | Stack | 482/146 |
| 6,824,147 | B1 | * | 11/2004 | Ouellette | 280/7.14 |
| 2002/0163144 | A1 | | 11/2002 | Guerra | |

FOREIGN PATENT DOCUMENTS

| | | | |
|---|---|---|---|
| DE | 195 42 061 | A1 * | 5/1997 |
| DE | 197 17 047 | A1 * | 10/1997 |

* cited by examiner

*Primary Examiner*—Frank Vanaman
(74) *Attorney, Agent, or Firm*—Edward J. DaRin, Esq.

(57) ABSTRACT

A stabilizing pad for use with conventional skateboards for ready attachment and detachment to the skateboard between the skateboard wheels for stabilizing the skateboard and immobilizing the wheels to permit a novice skateboarder to practice the basic balancing, maneuvers, and tricks on the skateboard without fear of falling or injuries. The stabilizing pad is temporarily secured to the skateboard to depend from the board for engagement with the supporting surface for the wheels and in sufficient contact therewith to provide the desired stabilizing action. The pad can be constructed of different lightweight materials or plastic for providing the necessary stabilizing of the skateboard.

3 Claims, 3 Drawing Sheets

METHOD AND APPARATUS FOR STABILIZING A SKATEBOARD FOR TRAINING NOVICE USERS OF SKATEBOARD

FIELD OF INVENTION

The present invention relates to skateboards or movable roller boards and methods and apparatus permitting training of novice users to practice balancing, maneuvers and tricks without being susceptible of falling or being injured.

BACKGROUND OF INVENTION

Skateboards must be mastered by the user to maintain the correct orientation on the board in attempting to move on the board to safely use the board and ride on the board. The wheels of a skateboard roll freely on bearings so that any slightest shift in weight by the user while on the skateboard causes a sudden movement of the board and when the user is a novice it will cause the novice to repeatedly fall to the ground and may cause injuries. As a result of this there are presently commercially available protective pads, i.e. knee pads, helmets, and the like to protect the novice upon falling from the skateboard. At the present time, I do not know of any commercially available training device that allows the development of the fundamental requirements for balancing on the board, maneuvers and advanced tricks on the skateboard without the need to purchase any of the aforementioned protective devices. Accordingly, there is a present need for a skateboard training device that allows a novice to develop the necessary skills for mastering the use of the skateboard without altering the construction of the skateboard.

The prior art discloses braking arrangements comprising braking pads located on the underside of occupant propelled wheel devices that are exemplified by the Shepherd U.S. Pat. No. 1,890,755; Funkee U.S. Pat. No. 3,887,210 and Fiore U.S. Pat. No. 5,413,544. Various devices have been proposed in the prior art for controlling a skateboard in use. The Thomas U.S. Pat. No. 4,235,448 discloses a skateboard configuration that prevents the excessive tilting of the skateboard as illustrated in FIG. 4. Similarly, the Scallon, Jr. U.S. Pat. No. 4,744,576 discloses a skateboard having an outrigger arrangement that provides stabilizing and braking action during maneuvers with the skateboard.

The only known disclosure directed to a training device for the use of a skateboard is found in U.S. Patent Application Publication No. U.S. 2002/0163144 A1 published Nov. 7, 2002 and bearing a U.S. filing date of Mar. 12, 2002. The training device disclosed in this publication merely consists of substituting a training device for the skateboard wheels at the exact location on the board of the wheel and truck assemblies. The training device is shaped to simulate the height, width and rocking motion of standard skateboard wheels. The aim of the device is to permit a user of the training device to practice tricks on the skateboard without incurring the risks associated with the standard skateboard wheels. The device is limited to the removal of the wheel trucks for training purposes and mounting the device in the exact location as the removed wheels. The device simulates the rocking motion of the wheels and therefore is not stable.

SUMMARY OF INVENTION

The skateboard training device and apparatus of the present invention is particularly useful for the novice skateboarder to safely use the skateboard without falling off of the board and without requiring the wearing and attendant cost of protective gear and without the need to modify the board as by removing the wheel structures required in the aforementioned patent publication. The present invention contemplates method and apparatus for stabilizing the skateboard and thereby immobilizing the wheel structures for the board to allow the novice to practice on the board. The apparatus for stabilizing the board comprises a pad mountable to the underside of the board between the wheel structures and constructed, designed and proportioned to have sufficient contact area with the supporting surface for the board for permitting use of the board without any movement thereof. The pad can be temporarily mounted to the skateboard so that the user can practice fundamental balancing on the board, maneuvers, tricks during the training process. The stabilizing of the board eliminates the fee wheeling of the board that causes sudden movement with the slightest shift in weight that normally causes the user to repeatedly fall and risk injury. the ability to master the board with the use of the present invention gives the learner confidence and thereby improving his over-all performance. The stabilizing pad can be readily removed from the skateboard once the learner has mastered the training.

BRIEF DESCRIPTION OF THE DRAWINGS

These and other features of the present invention may be more fully appreciated when considered in the light of the following specification and drawings, in which.

DETAILED DESCRIPTION OF THE PREFERRED EMBODIMENT

Figure 1:
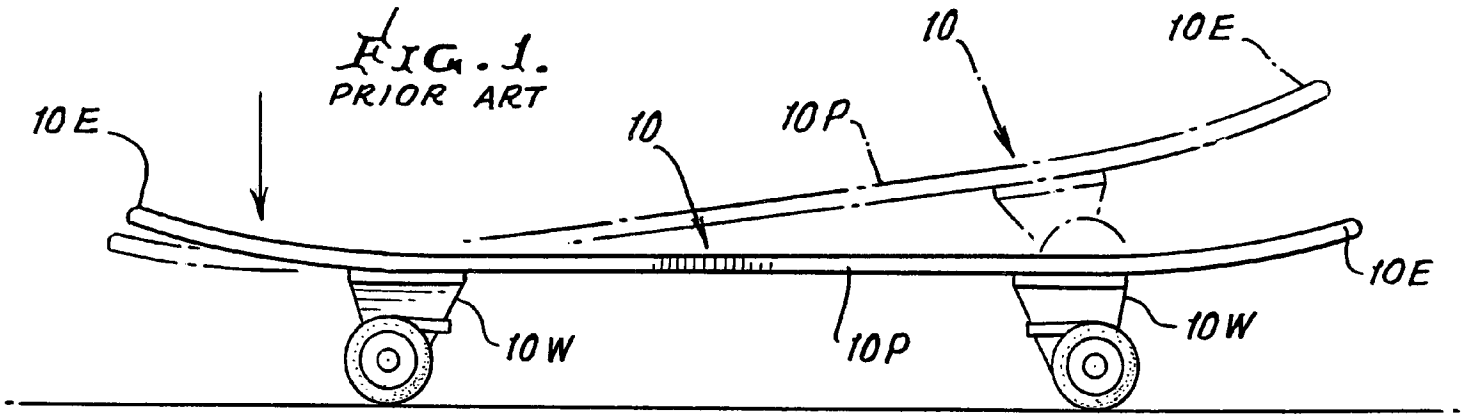
FIG. 1. PRIOR ART
FIG. 1 is a side elevational view of a prior art skateboard and illustrating in dotted outline an unbalanced force applied adjacent to one end of the skateboard and the resulting tilt at the other end of the skateboard.
Figure 4:
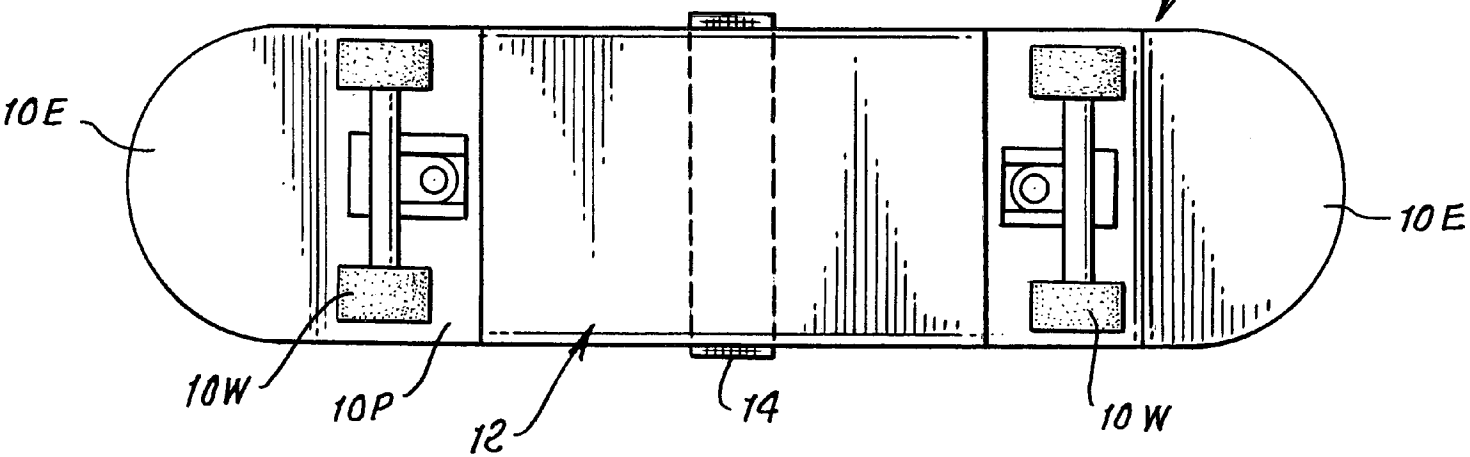
FIG. 4 is a bottom plan view of the skateboard with the stabilizing pad secured to the skateboard.

Now referring to the drawings, and with particular reference to FIG. 1, the basic problem solved by the present invention will be described in detail. The skateboard 10 illustrated in FIG. 1 is a present day construction of a skateboard that comprises a flat board with turned up ends 10E at a pre-selected angle to the longitudinal plane of the board 10 or the completely flat portion of the skateboard designated by the reference character 10P. The user of the board normally places his or her feet on the board in the area defined by the section 10P. The bottom side of the board 10 mounts a pair of conventionally constructed wheel truck assemblies 10W to the planar portion 10P of the board 10 immediately adjacent the upturned ends 10E as best illustrated in FIGS. 1 and 4. When a novice user of the skateboard 10 mounts his feet on the board 10 at an upturned portion 10E in an unbalanced condition, the weight of the novice user will cause the left hand terminal end of the board 10E to tilt downwardly, as represented by the arrow representing a downwardly extending force at the end 10E, so that the remaining portion of the skateboard will tilt upwardly as illustrated in dotted outline in FIG. 1. This unbalanced, tilting action may cause the novice user to fall off of the board, unexpectedly and may cause injury or bruising to the novice user. The adopting of the stabilizing pad 12 of the present invention by a novice will allow the novice to practice on the skateboard 10 without falling off of the board even though the novice has not mastered the balancing of the board 10 in use as will be more fully described hereinafter.

Figure 2:
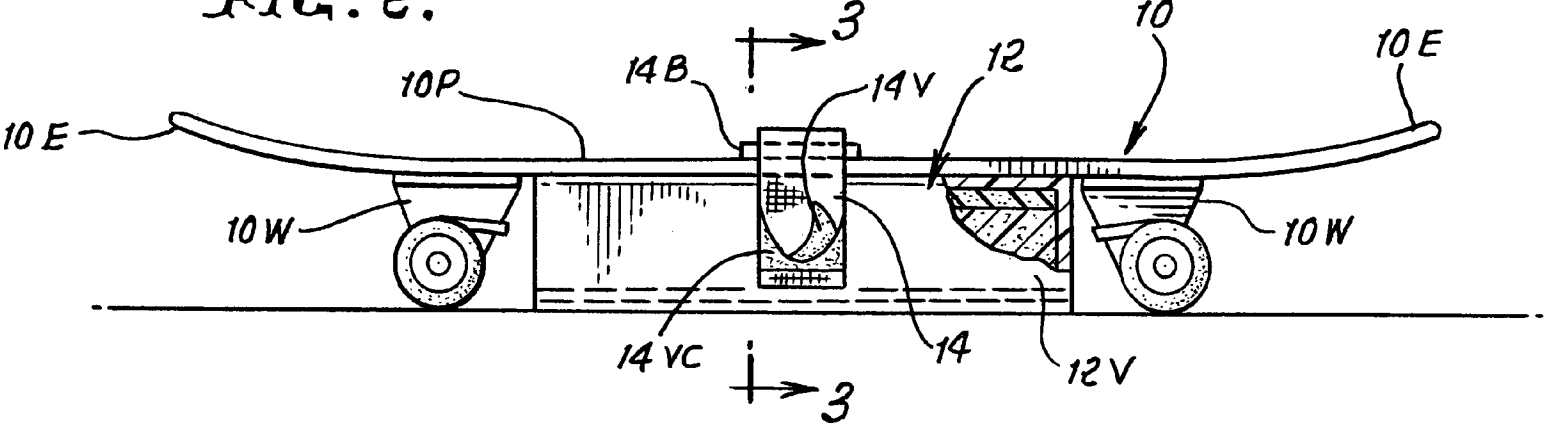
FIG. 2 is a side elevational view of the skateboard of FIG. 1 with the stabilizing pad embodying the present invention secured to the skateboard.

The stabilizing pad 12 of the presently preferred embodiment of the skateboard stabilizing pad is secured to the skateboard 10, temporarily, on the same side of the board 10 as the board wheels 10W and is arranged intermediate the board wheels 10W. The stabilizing pad 12 is dimensioned to depend from the back side of the planar portion 10P of the board 10 for engaging the supporting surface for the skateboard wheels 10W and is so constructed, designed and proportioned to have sufficient contact area with the board supporting surface for immobilizing the skateboard 10 to prevent the movement thereof for permitting a novice user to practice on the board. This combination of the skateboard 10 and the stabilizing pad 12 is best illustrated in FIG. 2. The pad 12 is temporarily secured to the board 10 by means of a velcro strap 14 wrapped around the skateboard as best seen in FIGS. 2 and 4. It should be understood that the velcro strap 14 or its equivalents are only exemplary of a simple device and/or method for temporarily securing and detaching the stabilizing pad 12 to the board 10 and other well know means or methods within the skill of the art may be employed for this temporary method of attaching and detaching the pad 12 to the skateboard 10. It should also be understood that when the stabilizing pad 12 is mounted to the skateboard 10, the wheels 10W are immobilized, as well, so the skateboard 10 will not roll or move on the wheels 10W when the pad 12 is properly constructed and attached to the board to further preventing unexpected movement of the skateboard 10 while being used by a novice skateboarder. Similarly, the skateboard 10 as presently one of the known conventional skateboards presently in use, but that the stabilizing invention may be utilized on other wheeled boards having various shapes and wheel assemblies used therewith including a completely flat board with wheel structures for use by a novice user in accordance with the teachings of the invention.

Figure 3:
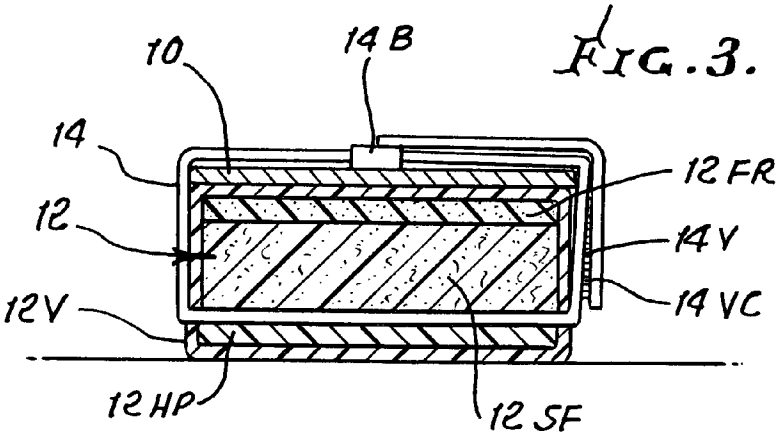
FIG. 3 is a cross sectional view of the stabilizing pad taken along line 3—3 of FIG. 2.
Figure 5:
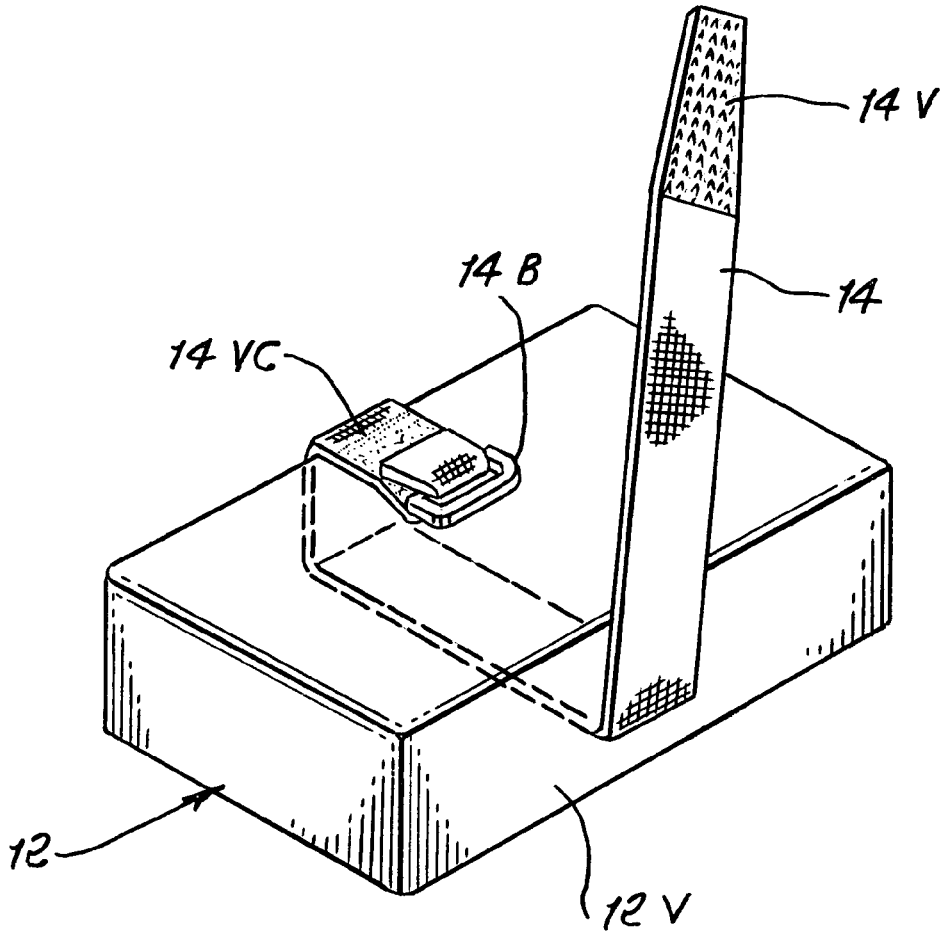
FIG. 5 is a perspective view of the detached stabilizing pad and securing strap.

Now referring to FIGS. 3–5, in particular, the detailed construction of the stabilizing pad 12 will be described as illustrated in the drawings. The stabilizing pad 12 comprises a foam rubber layer 12FR on the top side of the pad 12 for engaging the entire bottom surface of the board coextensive with the top surface of the pad 12 hug the board so as to flex or move in unison with the movements or flexing of the board 10. Immediately below the foam rubber layer 12FR is a layer of a lightweight plastic such as a styrofoam layer 12SF that is sandwiched between the foam rubber layer 12FR and a layer of a hard plastic or vinyl material 12HP for engaging the supporting surface. The plastic surface 12HP should be tough enough to withstand the rough surfaces it engages in use. This entire assembly of layers may be wrapped in a plastic cover such as a sheet of vinyl plastic 12V to maintain the various layers of the pad in an integral package. The thus assembled pad may include a conventional securing strap 14 having a separable fastener such as a VELCRO® hook and loop fastener at each end that can be mounted between the layers of the pad 12 as illustrated in the drawing as located between the hard plastic layer 12HP and the styrofoam layer 12SF and extending outwardly of the pad on opposite sides thereof with sufficient length to be strapped around the top surface of the board 10 and secured thereto; see FIGS. 2, 4, and 5. For this purpose one end of the securing strap 14 is provided with a buckle 14B for receiving the opposite end of the strap 14 having a separable fastener such as a VELCRO® fasteners 14V and 14VC at each end as illustrated in FIG. 5. The fastener 14VC is complimentary to the fastener surface 14V for securing the two surfaces when they are pressed together; see FIG. 2. It will be appreciated by those skilled in the art that the fastening means for temporarily securing the pad 12 to the board 10 need not be integrated into the stabilizing pad but can be a separate element. For example the securing strap 14 may be separate from the pad proper or may have a fastener other than separable fastener of the type of a VELCRO® hook and loop fastener and may be suitable for the purposes of the present invention.

The stabilizing pad 12 as illustrated and described hereinabove is mounted between the wheels 10W and has a length that is illustrated as being essentially coextensive with the length of the planar portion 10P of the board (see FIG. 2) and a vertical dimension to depend from the bottom side of the skateboard 10 for engaging the wheel supporting surface. This defines the necessary contact area between the bottom side of the pad 12 and the supporting surface for immobilizing the board 10 against movements that tend to cause the user to be thrown off the board or falling. It will be appreciated by those skilled in the art that a pad 12 of other dimensions may be utilized as long as the desired immobilization of the board and wheels are accomplished.

It should now be appreciated that once the novice has practiced sufficiently with the pad 12 secured to the board 10 to gain confidence using the board, the pad 12 can be readily removed by detaching the separable fastener or the VELCRO® hook and loop fastener and the strap 14 from the skateboard 10 and use the mobilized skateboard 10 in its usual fashion.

It should now be appreciated that the present invention has advanced the art of skateboarding by the provision of means for stabilizing the skateboard for use by novices in a simple, inexpensive manner that allows the novice skateboarder to practice on the skateboard when stabilized to learn the basic techniques for skateboarding without falling or injuries and without the need to purchase protective gear against falls so as to gain confidence in the use of the skateboard and improving the novice's performance.

The invention claimed is:

1. A method for novices to learn the fundamental skills for properly using a skateboard, comprising the steps of providing a skateboard having a flat board portion of pre-selected length for receiving the feet of a skateboard user thereon, the opposite ends of the flat board each having upturned ends of a pre-selected angle, the skateboard having a pair of wheel means for securement to the skateboard on the opposite side of the board from the user mounting side and each wheel means being secured to the flat portions of the board adjacent an individual upturned end, temporarily immobilizing said skateboard wheels and stabilizing the board from movement for permitting a novice user of the skateboard to practice fundamental balancing on the skateboard, maneuvers, and/or advance tricks without falling off the skateboard when the skateboard is temporarily stabilized wherein the step of temporarily immobilizing the skateboard wheels and stabilizing the board from user's movements on the skateboard includes the steps of selecting a pad comprised of a resilient material and dimensioned for engaging the supporting surface for the wheel means when mounted under the skateboard and to the skateboard and temporarily securing said pad under the skateboard and to the skateboard between the individual wheel means for engaging the supporting surface for the wheel means to thereby immobilize and stabilize the skateboard in situ and thereby immobilize said wheel means when the pad is secured to the skateboard, and including the step of providing a securing strap having a separable fastener at its ends, and wherein the step of securing the said pad to the skateboard comprises securing said pad with said securing strap having a separable fastener permitting the securement of the pad to the skateboard and readily releasably therefrom.

2. A method for novices to learn the fundamental skills for properly using a skateboard comprising the steps of providing a skateboard having a flat board portion of a pre-selected length for receiving the feet of a skateboard user thereon, the opposite ends of the flat board each having upturned ends of a pre-selected angle, the skateboard having a pair of wheel means for securement to the skateboard on the opposite side of the board from the user mounting side and each wheel means being secured to the flat portions of the board adjacent an individual upturned end, temporarily immobilizing said skateboard wheels and stabilizing the board from movement for permitting a novice user of the skateboard to practice fundamental balancing on the skateboard, maneuvers, and/or advance tricks without falling off the skateboard when the skateboard is temporarily stabilized wherein the step of temporarily immobilizing the skateboard wheels and stabilizing the board in situ from the user's movements on the skateboard includes the steps of selecting a pad comprised of a resilient material and dimensioned for engaging the supporting surface for the wheel means when mounted under the skateboard and to the skateboard, temporarily securing said pad under the skateboard and to the skateboard between the individual wheel means for engaging the supporting surface for the wheel means to thereby immobilize and stabilize the skateboard in situ and thereby immobilize said wheel means when the pad is secured to the skateboard and wherein the step of selecting a pad includes selecting a thin layer of resilient material to define the surface of the pad to be mounted adjacent the skateboard and a relatively harder material to extend between the resilient material and to extend adjacent the supporting surface for the skateboard upon mounting the pad to the skateboard and then wrapping the layer of resilient material and said harder material with a protective cover for the entire pad and selected to be a hard, thin material for engaging the supporting surface for the skateboard.

3. A method as defined in claim 2 wherein said pad includes providing a securing strap for temporarily securing the pad to the skateboard and allowing the pad to be readily detached from the skateboard.

* * * * *